United States Patent [19]

Lutz

[11] Patent Number: 4,885,922

[45] Date of Patent: Dec. 12, 1989

[54] LOCKING DRIVE FOR A CENTRAL LOCKING SYSTEM

[75] Inventor: Manfred Lutz, Schweinfurt, Fed. Rep. of Germany

[73] Assignee: Fichtel & Sachs AG, Schweinfurt, Fed. Rep. of Germany

[21] Appl. No.: 152,378

[22] Filed: Feb. 4, 1988

[30] Foreign Application Priority Data

Feb. 5, 1987 [DE] Fed. Rep. of Germany ..... 3703392

[51] Int. Cl.[4] ..... E05B 65/36

[52] U.S. Cl. ..... 70/264; 292/201; 292/336.3

[58] Field of Search ..... 70/264, 256, 237, 279; 292/201, 336.3, DIG. 3, 347

[56] References Cited

U.S. PATENT DOCUMENTS

| | | | |
|---|---|---|---|
| 4,290,634 | 9/1981 | Gelhard | 292/336.3 X |
| 4,342,209 | 8/1982 | Kleefeldt | 70/264 |
| 4,440,006 | 4/1984 | Kleefeldt | 70/264 |
| 4,502,718 | 3/1985 | Sasaki et al. | 292/336.3 |
| 4,674,781 | 6/1987 | Reece et al. | 292/336.3 |
| 4,708,378 | 11/1987 | Ingenhoven | 70/264 X |

FOREIGN PATENT DOCUMENTS

| | | | |
|---|---|---|---|
| 2557970 | 7/1977 | Fed. Rep. of Germany . | |
| 3226295 | 1/1984 | Fed. Rep. of Germany | 70/264 |
| 3408623 | 9/1985 | Fed. Rep. of Germany | 292/347 |
| 2847588 | 5/1988 | Fed. Rep. of Germany . | |

*Primary Examiner*—Lloyd A. Gall

*Attorney, Agent, or Firm*—Toren, McGeady & Associates

[57] ABSTRACT

The locking drive for a central locking system of a motor vehicle comprises a support which carries an electric motor, the direction of rotation of which is reversible. Guided for movement on the support are two force-transmitting parts of a gear mechanism which transmits the locking forces, a first force-locking part being adapted to be driven by the electric motor while a second force-locking part can be driven manually, for example by means of a mechanical lock. The second force-transmitting part can be locked at least in one of its extreme positions and relative to the support by means of a locking member. The locking member is controlled via the first force-transmitting part which, for this purpose, is coupled via a dead travel coupling having given clearance to the second force-transmitting part. The locking drive is in particular suitable for the locking of a trunk lock of the motor vehicle so that the trunk lock can be opened when the central locking system is locked without having to unlock the system again in order to perform this function.

2 Claims, 6 Drawing Sheets

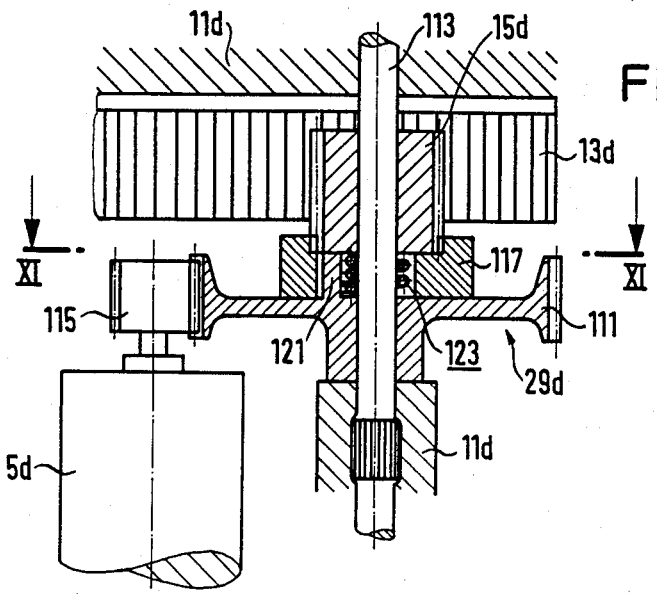
Fig. 10
Fig. 11
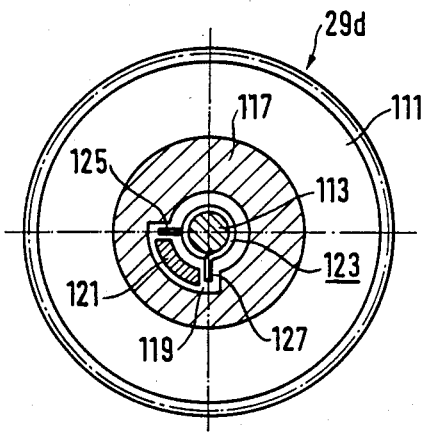

LOCKING DRIVE FOR A CENTRAL LOCKING SYSTEM

BACKGROUND OF THE INVENTION

The invention relates to a locking drive for a central locking system of a motor vehicle.

Electrically operated locking drives for central locking systems of motor vehicles must be able to move relatively smoothly so that the electric motors used can be of low power. Smoothness of movement does however entail the risk of force-transmitting parts of the locking drive being unintentionally moved, for example due to vibration or the like, resulting in an unintentional locking or unlocking of the system. It is known from German Patent application No. 28 47 588 for the push rod of a locking drive of a central locking system, driven by an electric motor, to be locked in its extreme positions by a spring catch. It is true that the spring catch enhances the inhibition in the extreme positions but it does, however, undesirably increase the resistance to displacement.

It is furthermore known to provide on the motor vehicle a plurality of locking positions, for example both on the doors and also on the trunk lid, via which all the locking drives of the central locking system can be centrally controlled. On the other hand, it is desirable to be able to open special locks, for example the trunk lock, even when the other locks have already been centrally locked. In the case of the central locking system according to German Patent application No. 28 47 588, there is connected in the drive path between key and trunk lock a spring which during opening is tensioned and which, after the key has been withdrawn from the lock, restores the locked condition. Similar springs which allow actuation of one lock regardless of the locked condition, for example by means of a "door button", are known from German Patent application No. 25 57 970. However, many of the conventional locking drives have the disadvantage that upon manual unlocking of one of the locking drives, the entire locking system is controlled to assume the unlocked condition. This is undesirable particularly when the trunk is being opened manually.

Finally, central securing systems are known which in addition to the locking drive have a second drive, for example a second electric motor, which moves a locking member into the path of displacement of the output rod of the locking drive so that the locked condition of the central locking system can also be maintained even under considerable externally acting forces.

The invention is directed towards provision of a simple locking drive for a central locking system, the force-transmitting parts of which offer only minimal resistance to displacement but which can however be reliably locked in their extreme positions.

SUMMARY OF THE INVENTION

In accordance with the invention, the drive path of the force-transmitting gear mechanism which transmits the locking forces comprises two force-transmitting parts of which a first one is coupled to an electric motor of the locking drive, while a second force-transmitting part is coupled to a manually actuated operating means, for example a "door button" or a lock which can be actuated by means of a key, particularly the lock of the trunk compartment. The two force-transmitting parts are guided for movement on a support which also supports the electric motor. Where the support is concerned, this may be a housing of the locking drive. The support may, however, also include other parts of a door or of a trunk lid. For locking the force-transmitting gear mechanism in the extreme positions of the locking drive, a locking means is provided of which the locking member fixes the second force-transmitting part in relation to the support. The locking means is controlled independently of the position of the first force-locking part. The electric motor is in this way used both for driving the locking members of the lock to be locked and also for locking the force-transmitting gear mechanism in its extreme positions.

The lock actuating device of the lock which is to be operated manually, for example the trunk lid lock, is expediently coupled to the second force-transmitting part via a flexible force-transmitting part, so that the trunk lock can be opened and closed without thereby unlocking the other centrally locked locks.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

FIG. 10 is a partial sectional view of a locking device comprising a fourth alternative embodiment of locking device; and FIG. 11 is a sectional view of the locking device taken on a line XI—XI in FIG. 10.

DETAIL DESCRIPTION OF THE DRAWINGS

Figure 1:
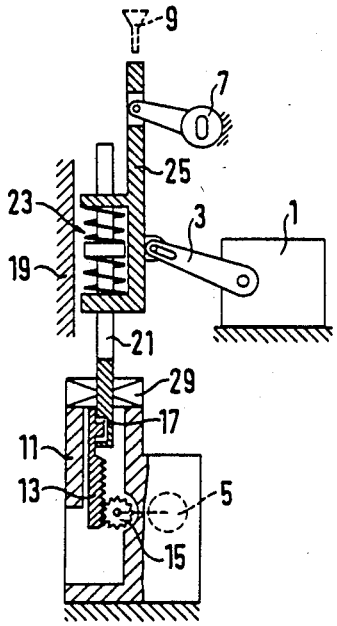
FIG. 1 is a diagrammatic view of a locking drive for a motor vehicle central locking system according to the invention.

FIG. 1 diagrammatically shows a locking drive for a central locking system of a motor vehicle, of which the doors and lid are in each case secured by a lock 1 which can be locked or unlocked by means of a lever 3. The locking drive illustrated is the locking drive of a trunk lock which can be centrally locked and unlocked on the one hand from a central locking station not shown in greater detail and which can, on the other, be unlocked and thus opened by means of a key via a mechanical lock 7 even when the vehicle is otherwise centrally locked. The locking drive is so constructed that upon manual unlocking via the lock 7, the central locking system is not controlled to move into its unlocked state. The locking drive is also suitable for the door locks of the motor vehicle and in this case manual unlocking or locking can also take place via a "door button" or the like indicated at 9.

The electric motor 5 mounted on a housing 11 is coupled to the locking lever 3 via a force-transmitting gear mechanism. The force-transmitting gear mechanism comprises, guided for linear movement in the housing 11, a rack 13 engaged by a pinion 15 which is likewise driven by the electric motor 5, possibly through a gear mechanism. The rack 13 is coupled via a dead travel coupling 17 in push-and-pull resistant manner but with a predetermined amount of dead travel, to an output rod 21 guided for displacement on the housing 11 or on a structural part 19 connected to the housing 11. The output rod 21 is in turn coupled via a resilient coupling element 23 to a linkage part 25 which acts directly or indirectly on the locking lever 3. The lock 7 or the door button 9 are coupled directly or indirectly to the linkage part 25 for manual drive of the locking lever 3. The flexible coupling element 23 is so dimensioned that it can on the one hand transmit to the locking lever 3 the displacing force exerted on the output rod 21 by the electric motor 5 and can on the other, when the output rod 21 is locked, allow the positioning movement of the linkage part 25 under manual drive.

The output rod 21 can, by means of a locking device 29 to be explained in greater detail hereinafter, be locked in its two extreme positions which correspond to the locked condition of the lock 1 or the unlocked condition relative to the housing 11. The locking device 29 is in this case controlled by the rack 13 which moves over the dead travel of the coupling 17. Thus, the locking device 29 offers only minimal resistance to the driving movement of the output rod 21.

If the lock 1 is used as a trunk lock so that the trunk can be opened manually and closed again via the lock 7, without the central locking system which, for example, may have been controlled to assume its locked condition likewise being unlocked and locked again. Thus it is possible to associate with the trunk lock or the door locks separate keys which are capable only of locking the locks which are respectively associated with them.

If necessary, it is possible to dispense with the flexible coupling element 23 so that the manually driveable linkage part 25 is coupled in push-and-pull resistant manner to the output rod 21. In this embodiment, the locking device 29 makes it possible to secure the manual actuating members 7, 9 against forced unlocking. In order nevertheless to be able manually to lock the lock 1, the locking device 29 expediently acts only in the unlocking direction.

Preferred examples of embodiment of the locking drive and particularly of its locking device will be explained hereinafter. Parts which have the same function are provided with the reference numerals shown in FIG. 1 and are provided with additional letters as a means of differentiation. By way of explanation, reference is made to the description of FIG. 1.

Figure 2:
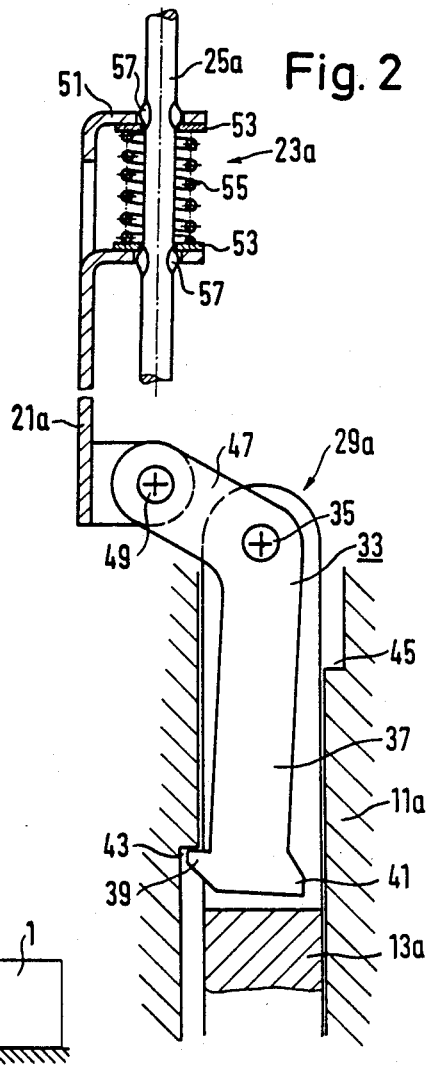
FIGS. 2 and 3 are partial views of a first alternative of a locking device which can be used in the locking drive according to FIG. 1, illustrated in the two extreme positions of the locking drive.
Figure 3:
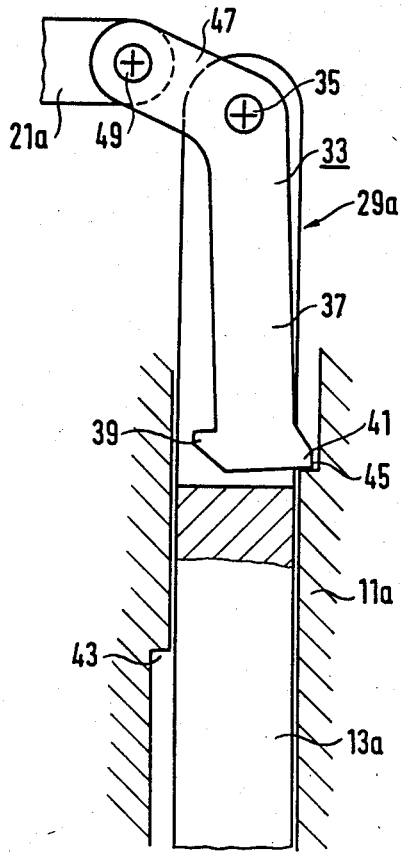

FIGS. 2 and 3 show details of a locking drive with a locking device **29*a* which is operative both in the unlocking direction and also in the locking direction. Pivotally mounted on the rack 13*a* of the locking drive which is guided for displacement in the housing 11*a* is a two-armed angled lever 33 which is adapted to pivot about a spindle 35 at right-angles to the direction of displacement of the rack 13*a*. A first arm 37 of the angled lever 33 which extends substantially in the direction of displacement of the rack 13*a* carries at its free end two projecting catches 39, 41 which project in opposite directions in the pivoting direction and which are intended to engage ratchet recesses 43, 45 on the housing 11*a*. The ratchet recesses 43, 45 are offset to each other in the direction of displacement of the rack 13*a* and have ratchet shoulders which are directed away from one another so that the ratchet projection 39 secures the angled lever 33 against being withdrawn from the housing 11*a* while the ratchet projection 41 secures the angled lever 33 against being pushed into the housing 11*a***.

The angled lever 33 is articulatingly connected to the output rod **21*a* which is guided for displacement substantially parallel with the rack 13*a* by its second arm 47 which projects transversely to the direction of displacement of the rack 13*a*. The arm 47 provides not only for push-and-pull resistant connection of the rack 13*a* to the output rod 21*a* but also controls the pivoting movement of the arm 37 for engagement of the locking projections 39, 41 into the recesses 43, 45 of the housing 11*a*. The rack 13*a* and the output rod 21*a*** are to this end adapted for movement relative to each other and over a limited travel.

FIG. 2 shows the rack **13*a* in its position normally associated with the locked condition of the lock, retracted into the housing 11*a*, a position in which the locking projection 39 engages the recess 43 securing the output rod 21*a* against withdrawal, i.e. in the unlocking direction. If the rack 13*a* is pushed out of the housing 11*a* by the electric motor, then in addition to the shearing force acting on the output rod 21*a* via the arm 47, a torque is exerted on the angled lever 33 which pivots the angled lever 33 about its mounting 49, lifting the locking projection 39 out of the recess 43. In the other extreme position, the torque forces the locking projection 41 into the recess 45 (FIG. 3), so that the output rod 21*a* is locked against being pushed in, i.e. in the locking direction. Upon retraction of the rack 13*a* into the housing 11*a*. by means of the electric motor, on the other hand, a torque is once again exerted on the angled lever 33 which pulls the locking projection 41 out of the recess 45**.

FIG. 2 shows details of a flexible coupling element **23*a*. It comprises, swaged onto the output rod 21*a*, a fork 51 which maintains tensioned a coil thrust spring 55 which is provided at both ends with thrust plates 53. The linkage part 25*a* traverses the fork 51 and the coil thrust spring 55 in displaceable manner and is, outside the thrust plates 53, provided with entraining lugs 57 which are braced on the thrust plates 53. The linkage part 25*a* can therefore be displaced in both directions of movement relative to the fork 51 and thus towards the output rod 21*a*, against the force of the spring 55**.

Figure 4:
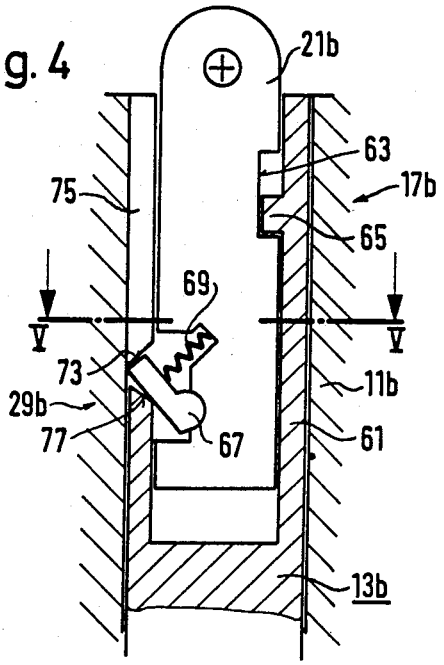
FIG. 4 shows a partial view of a second alternative of locking device.
Figure 5:
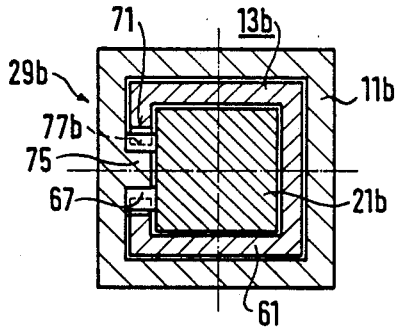
FIG. 5 is a sectional view through the locking device taken on the line V—V in FIG. 4.

FIGS. 4 and 5 show an alternative embodiment of locking device **29*b* which blocks the output rod 21*b* against being withdrawn manually from the housing 11*b* but only in one direction, preferably the unlocking direction. The rack 13*b* guided for linear displacement in the housing 11*b* carries a sleeve projection 61 in which the output rod 21*b* is in turn guided for displacement parallel with the direction of displacement of the rack 13*b*. A dead travel coupling 17*b* having a stud 65 which, from the sleeve projection 61, engages a recess 63 in the output rod 21*b*, limits the relative movement between output rod 21*b* and rack 13*b* and otherwise provides for a push-and-pull resistant coupling between these parts. Pivotally mounted on the output rod 21*b* is a catch 67 which is tensioned by a spring 69 through a cut-out 71 in the sleeve projection 61, being biased against an end face 73 of a rib 75 of the housing 11*b* which extends in the direction of displacement of the rack 13*b*. The catch 67 projects laterally beyond the rib 75 and by reason of the relative movement between the output rod 21*b* and the rack 13*b*, is disengaged by control edges 77 of the cut-out 71**.

FIG. 4 shows the output rod **21*b* and the rack 13*b* in the position usually associated with the locked state, retracted into the housing 11*b*. In this position, the output rod 2l*b* is locked against being withdrawn manually from the housing 11*b*. However, if the rack 13*b* is pushed out of the housing 11*b* by the electric motor, then the catch 67 is released while the dead travel of the coupling 17*b* is overcome before the rack 13*b* then also entrains the output rod 21*b* with it. Pushing in of the output rod 21*b* and of the rack 13*b* into the housing 11*b*** can, on the other hand, take place both manually and also via the electric motor.

Figure 6:
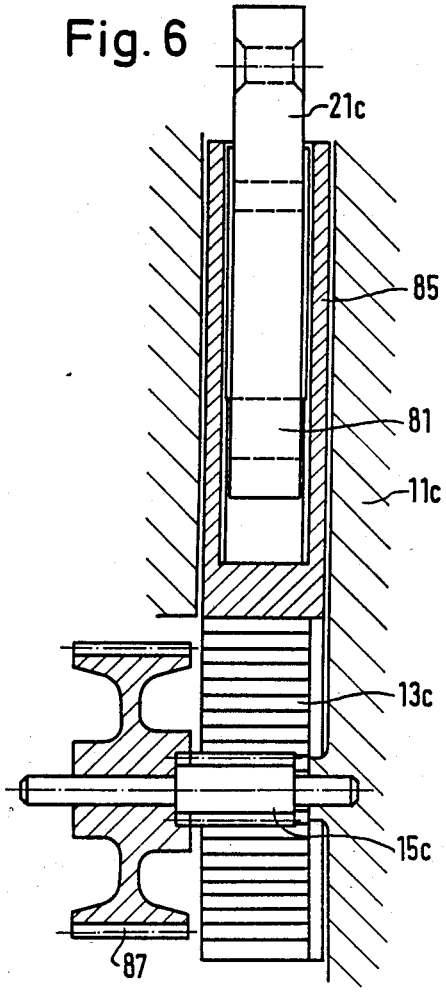
FIG. 6 is a partly sectional view through a locking drive with a third alternative embodiment of locking device.

FIGS. 6 to 9 show a further alternative embodiment of locking drive of which the output rod **21*c* can be locked relative to the housing 11*c* in both extreme positions of the locking drive, i.e. both in the locked position and also in the unlocked position, by catches 81, 83. The output rod 21*c*, similarly to the embodiment shown in FIGS. 4 and 5, is displaceably mounted in its sleeve projection 85 of the rack 13*c* which is guided in the housing 11*c* for displacement in the same direction. FIG. 6 furthermore shows the pinion 15*c* which meshes with the rack 13*c* and which, in the example of embodiment illustrated, is driven via an intermediate gearwheel 87** in both directions of movement by the electric motor which is not shown here in greater detail.

Figure 7:
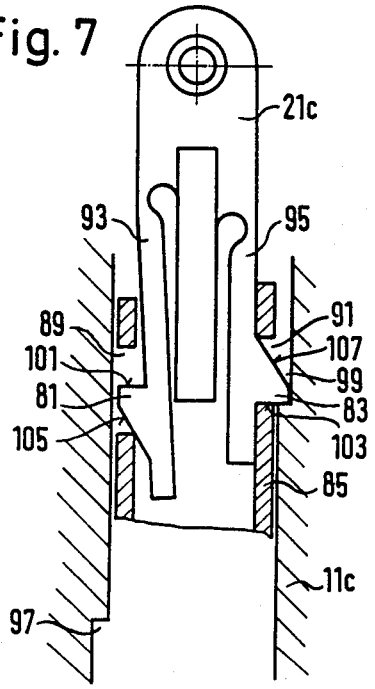
FIGS. 7 to 9 are partly sectional side elevations of the locking device according to FIG. 6 in different positions of use.
Figure 8:
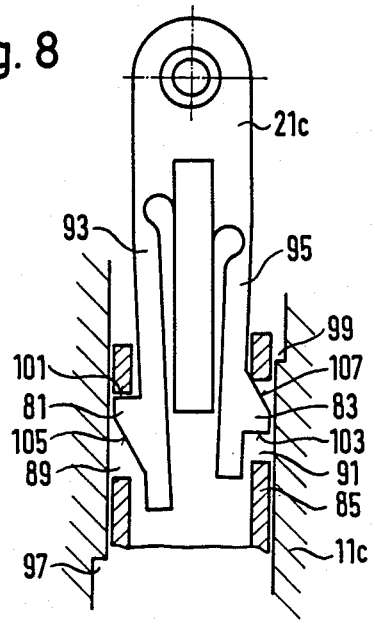
Figure 9:
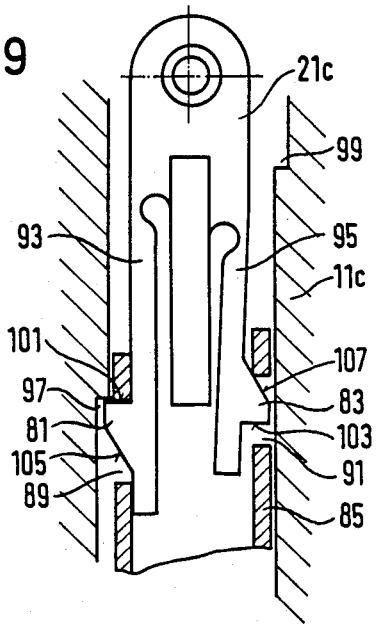

As can be seen in FIGS. 7 to 9, the sleeve projection 85 has windows 89, 91 through which catches 81, 83 which are connected by spring tongues 93, 95 integrally and resiliently to the output rod **21*c* engage in recesses 97, 99 in the housing 11*c*. The ratchet recesses 97, 99 are offset in respect of each other in the direction of displacement and have, directed away from one another, ratchet shoulders associated with complementary ratchet shoulders 101, 103 on the catches 81, 83. The catches 81, 83 have their respective ratchet shoulders 101, 103 positioned opposite sloping thrust faces 105, 107 via which they are lifted out of the ratchet recesses 97, 99 by associated control edges of the windows 89, 91. Disposed opposite the control edges of the windows, the windows 89, 91 form entraining edges via which, once the dead clearance of the catches 81, 83 in the windows 89, 91 has been overcome, the sleeve projection 85 entrains the output rod 21*c***.

FIG. 7 shows the output rod in the position normally associated with the unlocked condition of the locking system, pushed out of the housing **11*c*. The catch 83 engages the ratchet recess 99, locking the output rod 21*c* against being pushed back manually. However, if the rack 13*c* is drawn into the housing 11*c* by the electric motor, then the catch 83 is lifted out of the ratchet recess 99 via its oblique thrust face 107. The entraining edge of the window 89 which abuts the shoulder 101 of the other catch 81 entrains the output rod 21*c* (FIG. 8). FIG. 9 shows the position of the output rod 21*c* (locking position), retracted into the housing 11*c*, in which the catch 81 has snapped by spring action into the ratchet recess 97, locking the output rod 21*c* against being withdrawn manually. The push-out movement of the output rod 2*c***, controlled by the electric motor, takes place in the corresponding fashion.

The aforementioned embodiments of the locking drive lock the output rod which is otherwise adapted for translatory movement relative to the housing. However, the locking device can also be disposed anywhere else in the drive path. FIGS. 10 and 11 show a locking device **29*d* which locks the rotary movement of the drive pinion 15*d* which meshes with the rack 13*d*, relative to the housing 11*d*. Together with an intermediate gearwheel 111, the pinion 15*d* is mounted to be freely rotatable on a spindle 113 which is rigidly supported in the housing 11*d*. The intermediate gearwheel 111 in turn meshes with a pinion 115 mounted on the shaft of the electric motor 5*d***.

The pinion **15*d* is adapted for limited rotation relative to the gearwheel 111 and carries in rotationally rigid fashion a coupling piece 117 which annularly encloses the spindle 113. The coupling piece 117 has a recess 119 in the shape of a segment of a circle, engaged axially by a projection 121 which is formed integrally on the gearwheel 111. The coupling piece 117 furthermore comprises a helical wrap-around spring 123 mounted in frictionally locking fashion on the spindle 113, the ends of which are bent out radially into legs 125, 127. The legs 125, 127 extend into the segment-shaped recess 119 in the coupling piece 117 and accommodate the projection 121 between them. Each of the legs 125, 127 thus engages between peripherally oppositely disposed abutment faces of the recess 119 on the one hand and the projection 121 on the other. If the wrap-around spring 123 is loaded via the pinion 15*d* and the coupling piece 117 from the side of the rack 113*d*, then it retracts and blocks the rotary movement in respect of the spindle 113 which is rigid with the housing. Upon a rotation of the gearwheel 111 by the motor 5*d*, on the other hand, the projection 121 opens up the wrap-around spring 123 and the projection can then drive the rack 13*d* via the coupling piece 117 and the pinion 15*d***. Driving and locking are effective in both directions of movement.

The projection 121 and the segment-shaped recess 119 of the coupling piece 117 in turn form a dead travel coupling, of which the even comparatively small dead travel makes it possible t release the brake formed by the wrap-around spring 123.

While specific embodiments of the invention have been shown and described in detail to illustrate the application of the inventive principles, it will be understood that the invention may be embodied otherwise without departing from such principles.

What I claim is:

1. A locking drive for a central locking system of a motor vehicle, comprising:

(a) a support;

(b) a reversible electric motor mounted on the support;

(c) a manual lock activating device adapted for movement relative to the support;

(d) a force-transmitting gear mechanism of which the drive path transmitting the lock restoring forces comprises two force-transmitting parts guided for translatory movement on the support and of which a first force-transmitting part is operatively coupled to be driven in the locking direction and in the unlocking direction by the electric motor, and of which a second force-transmitting part is operatively coupled to be driven manually by means if the lock activating device in the locking direction and in the unlocking direction, the first force-transmitting part being disposed in the drive path between the electric motor and the second force-transmitting part, the second force-transmitting part carrying at least one catch pretensioned to elastically engage in a ratchet recess of the support, the first force-transmitting part comprising, associated with the catch, a lifting means for lifting the catch out of the ratchet recess, the first and the second force-transmitting parts being coupled to each other in the drive path via an idle travel coupling which permits a limited idle travel of the first and of the second force-transmitting part relative to each other; and (e) a locking means with a locking member for arresting the second force-transmitting part at least in the unlocking direction relative to the support and with a control arrangement controlling the locking member according to the position of the first force-transmitting part, the locking member being mounted on the second force-transmitting part for movement transversely of the direction of movement of the second force-transmitting part.

2. A locking drive according to claim 1, wherein the second force-transmitting part is guided for displacement in a sleeve projection if the first force-transmitting part and wherein the catch engages through a cut-out in the sleeve projection and into the ratchet recess.

* * * * *